US005279615A

United States Patent [19]

Mitchell et al.

[11] Patent Number: 5,279,615

[45] Date of Patent: Jan. 18, 1994

[54] METHOD AND COMPOSITION USING DENSIFIED CARBON DIOXIDE AND CLEANING ADJUNCT TO CLEAN FABRICS

[75] Inventors: James D. Mitchell, Alamo; Daniel T. Carty, Danville; James R. Latham, Livermore, all of Calif.

[73] Assignee: The Clorox Company, Oakland, Calif.

[21] Appl. No.: 715,299

[22] Filed: Jun. 14, 1991

[51] Int. Cl.[5] ..... D06L 1/02; D06L 1/00; D06L 1/08

[52] U.S. Cl. ..... 8/142; 8/137; 134/26; 134/31; 134/42

[58] Field of Search ..... 8/137, 142; 134/26, 134/31, 42; 252/162, 170, DIG. 19

[56] References Cited

U.S. PATENT DOCUMENTS

| | | | |
|---|---|---|---|
| 2,820,761 | 1/1958 | Anthony | 252/8 |
| 3,969,196 | 7/1976 | Zosel | 203/49 |
| 4,012,194 | 3/1977 | Maffei | 8/142 |
| 4,093,418 | 6/1978 | Compton et al. | 8/142 |
| 4,219,333 | 8/1980 | Harris | 8/137 |
| 4,289,644 | 9/1981 | Steinhauer et al. | 252/170 |
| 4,308,200 | 12/1981 | Fremont | 260/110 |
| 4,559,133 | 12/1985 | Siegfried et al. | 208/177 |
| 4,594,362 | 6/1986 | Smith et al. | 252/90 |
| 4,820,537 | 4/1989 | Katz | 426/481 |
| 4,867,997 | 9/1989 | Wiesenberger | 426/387 |
| 5,013,366 | 5/1991 | Jackson et al. | 134/1 |

FOREIGN PATENT DOCUMENTS

| | | | |
|---|---|---|---|
| 2027003 | 12/1971 | Fed. Rep. of Germany | D06L 1/08 |
| 3904513 | 6/1990 | Fed. Rep. of Germany | A61L 2/16 |
| 3904514 | 8/1990 | Fed. Rep. of Germany | D06L 1/00 |
| 4004111 | 8/1990 | Fed. Rep. of Germany | D06L 1/00 |
| 3906724 | 9/1990 | Fed. Rep. of Germany | D06P 1/00 |
| 3906735 | 9/1990 | Fed. Rep. of Germany | D06L 3/00 |
| 90/06189 | 6/1990 | PCT Int'l Appl. | B08H 7/00 |
| 0798156 | 1/1981 | U.S.S.R. | 252/67 |

OTHER PUBLICATIONS

"Carbon Dioxide," *Kirk-Othmer Encycl. Chem. Tech.*, 3rd Ed., vol. 4, pp. 715-742 (1978).

A. Francis, "Ternary Systems of Liquid Carbon Dioxide," *J. Phys. Chem.*, pp. 1099-1114 (1954).

J. Hyatt, "Liquid and Supercritical Carbon Dioxide as Organic Solvents," *J. Org. Chem.*, vol. 49, pp. 5097-5100 (1984).

Search Report from European Patent Application No. 92.305338.3 (equivalent hereof) Sep. 9, 1992.

H. Brogle, "$CO_2$ in Solvent Extraction," *Chem. and Ind.*, pp. 385-390 (1985).

"Supercritical Fluids," *Kirk-Othmer Encycl. Chem. Tech.*, 3rd Ed., Suppl., vol. 24, pp. 872-893 (1983).

K. Poulakis et al., "Dyeing Polyester in Supercritical $CO_2$," *Chemiefasern/Textilindustire*, vol. 41/93, Feb. 1991.

Technical Support Package, "Cleaning with Supercritical $CO_2$," NAPA Tech Briefs MFS-29611 Mar. 1979.

K. Motyl, "Cleaning Metal Substrates Using Liquid Supercritical Fluid Carbon Dioxide," RFP-4150 (1988).

"Supercritical Fluids Attracting New Interest," *Inform*, vol. 1, pp. 810-816 (1990).

M. Cygnarowicz et al., "Effect of Retrograde Solubility on the Design Optimization of Supercritical Extraction Processes," *Ind. Eng. Chem. Res.*, vol. 28, pp. 1497-1503 (1989).

(List continued on next page.)

*Primary Examiner*—Linda Skaling
*Attorney, Agent, or Firm*—Joel J. Hayashida; Michael J. Mazza; Harry A. Pacini

[57] ABSTRACT

The invention provides a method and composition for the removal of nonpolar stains from a fabric comprising: contacting said stains with densified carbon dioxide and a cleaning adjunct in mixture with said carbon dioxide.

8 Claims, 1 Drawing Sheet

OTHER PUBLICATIONS

"Hydrocarbons (Survey)," *Kirk-Othmer Encycl. Chem. Tech.*, vol. 12, pp. 870-937 (1980).

B. Brady et al., "Supercritical Extraction of PCB Contaminated Soils," (no date available).

B. Brady et al., "Supercritical Fluid Extraction of Hazardous Waste from Contaminated Soils," 1985.

M. Cygnarowicz et al., "Design and Control of a Process to Extract beta-Carotene with Supercritical Carbon Dioxide," *Biotech Prog.*, vol. 6, pp. 82-91 (1990).

H. Vollbrecht, "Advantages and Limitations of the $CO_2$ High Pressure Extraction Process for Extracting Natural Raw Material in Large Scale Production," pp. 269-273 (no date available).

M. Cygnarowicz et al., "Equilibrium Solubilities of Beta-Carotene in Supercritical Carbon Dioxide," *Fluid Phase Equilibrium*, pp. 1-18, 1990 (In Press).

L. Tillman et al., "Pulping of Southern Pine Under Low Water, Alkaline Conditions Using Supercritical Carbon Dioxide-Sulfur Dioxide Mixes," *TAPPI J.*, pp. 140-146 (1990).

P. Gallagher et al., "Supercritical Processing of Polymers," pp. 668-670 (no date available).

B. Subramanian et al., "Reactions in Supercritical Fluids," *Ind. Eng. Process Des. Div.*, vol. 25, pp. 1-12 (1986).

V. Krukonis, "Processing with Supercritical Fluids," pp. 26-43 (1988).

METHOD AND COMPOSITION USING DENSIFIED CARBON DIOXIDE AND CLEANING ADJUNCT TO CLEAN FABRICS

BACKGROUND OF THE INVENTION

1. Field of the Invention

The invention provides a method and composition for the removal of especially nonpolar stains from fabrics by using a mixture of densified carbon dioxide and a cleaning adjunct, which is a nonpolar liquid.

2. Brief Statement on Related Art

There has been limited recognition in the use of carbon dioxide to clean fabrics. Carbon dioxide has been used a standard propellant in the delivery of foaming cleaning products, e.g., Harris, U.S. Pat. No. 4,219,333.

Maffei, U.S. Pat. No. 4,012,194, described a dry cleaning system in which chilled liquid carbon dioxide is used to extract soils adhered to garments. The liquid carbon dioxide is converted to gaseous carbon dioxide, the soils removed in an evaporator and the gaseous carbon dioxide is then recycled. Maffei, however, does not teach, disclose or suggest the use of additional cleaning adjuncts in connection with his chilled liquid carbon dioxide dry cleaning system.

More recently, the use of supercritical fluids, e.g., carbon dioxide whose temperature has been elevated to past a so-called critical point, has been studied for the purposes of solvent extraction, as in, e.gs., Kirk-Othmer, Encycl of Chem. Tech., 3d Ed., Vol. 24 (Supplement), pp. 872–893 (1983) and Brogle, "$CO_2$ in Solvent Extraction," *Chem. and Ind.*, pp. 385–390 (1982). This technology is of high interest because of the need for little or no organic solvents in such extraction processes, which is very desirable from an environmental standpoint.

However, none of the prior art discloses, teaches or suggests the combination of densified carbon dioxide and a cleaning adjunct as a cleaning agent for the removal of soils and stains from fabrics, said cleaning adjunct being a nonpolar liquid. Nor does the art teach, disclose or suggest the use of such combination of densified carbon dioxide and a cleaning adjunct as a cleaning agent as a dry cleaning process, the novel combination providing an environmentally safe alternative to the use of ordinary dry cleaning materials such as Stoddard solvent or perchloroethylene ("perc").

SUMMARY OF THE INVENTION AND OBJECTS

The invention provides, in one embodiment, a method for the removal of nonpolar stains from a fabric comprising:

contacting said stains with densified carbon dioxide and a nonpolar cleaning adjunct in admixture with said carbon dioxide.

In a further embodiment is provided a cleaning agent for removing nonpolar stains from fabrics comprising a mixture of densified carbon dioxide and a cleaning adjunct, said cleaning adjunct being a nonpolar liquid.

It is therefore an object of this invention to provide a novel cleaning agent which uses densified carbon dioxide and a cleaning adjunct therewith.

It is another object of this invention to provide a method for the dry cleaning of fabrics while avoiding significant use of such solvents as perchloroethylene and Stoddard solvent, or similar hydrocarbon solvents.

It is yet another object of this invention to clean stained fabrics with a combined densified carbon dioxide/adjunct system which has surprisingly superior performance over the use of either carbon dioxide or adjunct alone applied to the stain.

It is a further object of this invention to remove nonpolar soils from fabrics while avoiding the use of water and other solvents which could, upon removal from the fabric, cause damage to the fabric by shrinkage or warping.

DETAILED DESCRIPTION OF THE PREFERRED EMBODIMENTS

Figure 1:
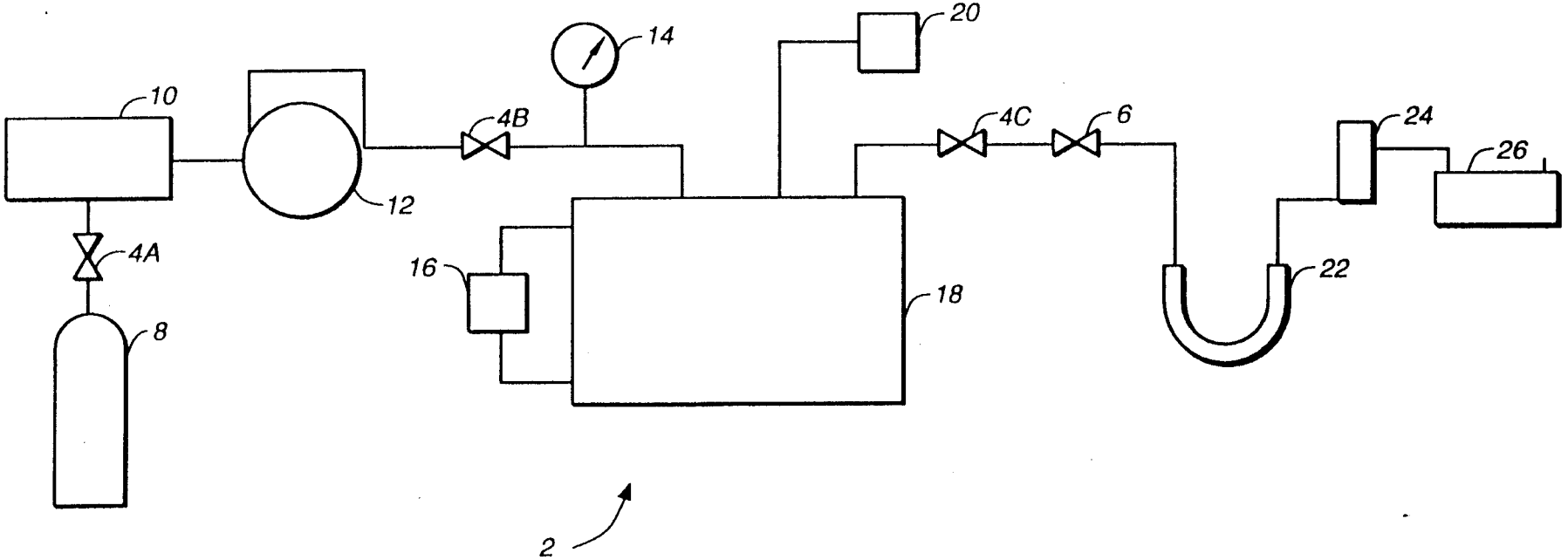
FIG. 1 is a schematic of a preferred embodiment of the invention, namely, a dry cleaning operation.

The invention provides a cleaning agent and method for removing nonpolar stains from fabrics comprising a mixture of densified carbon dioxide and a cleaning adjunct. As noted above, a particularly preferred application of the invention is in the use of the cleaning admixture for the nonaqueous cleaning of stained fabrics commonly known as dry cleaning.

Dry cleaning is conducted primarily by small businesses, many of which have been in operation for many years prior to the onset of stringent environmental legislation regarding the use and disposal of organic solvents, e.g., perc and Stoddard solvent. Because of the ever-growing concern that ground waters may become contaminated by the widescale use of such solvents, much of this new legislation has been promulgated to regulate such use and disposal. Consequently, there is a great need for alternate ways of cleaning fabrics avoiding the use of such solvents, while obtaining effective cleaning for garments and other fabrics for which aqueous washing is contraindicated.

In the present invention, numerous definitions are utilized:

"Densified carbon dioxide" means carbon dioxide, normally a gas, placed under pressures generally exceeding preferably 800 psi at standard temperature (21° C.).

"Nonpolar cleaning adjuncts" refer to nonpolar materials which are typically liquids at room temperature (21° C.) and preferably, have a viscosity of 0.5 centipoise ("cps") or greater. They are not necessarily solvents or cleaners in the classic sense, but in the invention, function to remove soils from fabrics.

"Nonpolar stains" are those which are at least partially made by nonpolar organic compounds, such as hydrocarbon compounds (petroleum based products, such as motor oil), and other compounds typically considered to form oily soils, e.gs., without limitation, carboxylic acids (fatty acids), glycerides, sebum and the like.

"Supercritical" phase means when a substance, such as carbon dioxide, exceeds a critical temperature (e.g., 31° C.), at which point the material cannot be condensed into the liquid phase despite the addition of further pressure.

1. Densified carbon dioxide

Carbon dioxide ($CO_2$) is a colorless gas which can be recovered from coal gassification, synthetic ammonia and hydrogen generation, fermentation and other industrial processes. (*Kirk-Othmer, Encycl. Chem. Tech.*, 3rd Ed., Vol. 4, pp. 725–742 (1978), incorporated herein by reference thereto.)

In the invention, densified carbon dioxide is used as a solvent for removing soils and stains from fabrics, in conjunction with the viscous cleaning adjunct. Densified carbon dioxide, as defined above, is carbon dioxide which has been placed under greater than atmospheric pressure or low temperature to enhance its density. In contrast to carbon dioxide used in pressurized cannisters to deliver foamed products, e.g., fire extinguishers or shaving creams, densified carbon dioxide is preferably at much greater pressures, e.g., 800 p.s.i. and greater. It has been found that density, rather than temperature or pressure alone, has much greater significance for enhancing the solvent-like properties of carbon dioxide. See, H. Brogle, "$CO_2$ as a Solvent: its Properties and Applications, " *Chem. and Ind.*, pp. 385-390 (1982), incorporated by reference thereto.

Types of densified carbon dioxide which would be of utility herein include densified carbon dioxide, supercritical carbon dioxide and liquid carbon dioxide. The concept of dense carbon dioxide encompasses these other types of carbon dioxides. Other supercritical fluids appear suitable for use, and include liquids capable of gassification, e.gs., ammonia, lower alkanes ($C_{1-5}$) and the like.

The amount, or volume, of densified carbon dioxide or other supercritical fluid would depend on the type of substrate, temperature and pressure involved. Generally, an amount which is effective to remove the stain is used. Thus, for the purposes of this invention, cleaning-effective amounts are used.

2. Viscous Cleaning Adjunct

By itself, densified carbon dioxide has relatively poor soil removal performance. Surprisingly, applicants have discovered that the addition of a relatively viscous cleaning adjunct, generally speaking, an organic compound, can unexpectedly improve the removal of oily soils, particularly, hydrocarbon-based soils, from fabrics soiled with such oily soils. This is all the more surprising considering that such cleaning adjuncts themselves are not very effective at removing such oily soils from fabrics in the absence of densified carbon dioxide.

The cleaning adjuncts used herein are generally, nonpolar organic chemicals. Preferably, such adjuncts are nonpolar. As mentioned above, the adjuncts preferably have a viscosity of at least about 0.5 centipoise at standard temperature. Nonpolar compounds useful herein include hydrocarbon (alkane) compounds, as well as alcohols, aldehydes, carboxylic acids, ketones, ketones, esters, their derivatives and mixtures of the foregoing.

Preferred cleaning adjuncts are the $C_{5-24}$ alkanes. These may be n-, s-, unsubstituted, substituted, cyclo-, branched and mixtures thereof. Especially preferred are paraffin oils, which have a mixture of alkanes and include some portion of $C_{16}$ and higher hydrocarbon content. Examples include mineral oil and petrolatum.

Referring particularly to hydrocarbon cleaning adjuncts, it has been found that when paraffins are used as the cleaning adjunct with densified carbon dioxide, especially enhanced cleaning, beyond that expected by the combination thereof, is achieved against a nonpolar stain (dirty motor oil). This synergistic cleaning action was unexpected and evidences the superior performance of the cleaning method and composition hereunder.

It is also important to recognize that the cleaning adjunct is not a part of the homogeneous, densified or supercritical fluid system. Instead, the cleaning adjunct is added to the fabric to be cleaned either prior to, or at substantially the same time as, the application of the densified fluid, forming a heterogeneous cleaning system. Thus, the use of these cleaning adjuncts is readily distinguishable from prior art systems, in which entrainers, or co-gassifiable substances form part of the densified or supercritical fluid matrix.

The amount, or volume of the cleaning adjunct similarly varies, but is most preferably a soil-solubilizing or -removing amount. The precise mechanism for soil removal in this invention is not completely understood and thus, precise characterization of the amount of the adjunct is not presently available. However, generally speaking, although nonpolar cleaning adjuncts were found not effective at removing nonpolar soils from fabrics by themselves, in conjunction with the densified carbon dioxide, unexpectedly effective cleaning was achieved.

In the practice of the best mode of this invention, reference is conveniently made to the drawing, FIG. 1, which is a schematic depiction of the dry cleaning process and equipment suited thereto.

In FIG. 1 is generally depicted the dry cleaning operation 2. A pressurized gas cylinder 8 contains densified $CO_2$, whose outflow can be regulated by in-line valve 4A. The gas cylinder is connected by means of tubing to pump 10, e.g, an electrically driven LDC pump, which pressurizes the $CO_2$ along with regulator 12. A further valve 4B passes densified $CO_2$ to be read by pressure gauge 14. The densified $CO_2$ is fed into autoclave 18, in which the soiled fabrics are placed. The temperature of the densified $CO_2$ is controlled by passing the $CO_2$ through a heat exchange coil 16 located in autoclave 18. The temperature is measured by a digital thermometer 20 connected to a thermocouple (not shown). The densified $CO_2$ and soil is then passed through valve 4C which is in line with heated control valve 6, which controls the extraction rate. Further downstream, an expansion vessel 22 collects the extracted soils, while flow gauge 24 measures the rate of extraction. The gas meter 26 measures the volume of $CO_2$ used.

Using the operation outlined above, extractions of oily soils were undertaken using a preferred embodiment of the invention, in which the stained fabric was contacted with paraffin oil (about $C_{18}$ alkane) for about 15 minutes and then treated with dense $CO_2$. This was compared against the extraction by dense $CO_2$ and paraffin oil singly.

EXPERIMENTAL

Several cotton swatches (Testfabric Inc. #400) were uniformly stained with dirty motor oil drained from an automobile crankcase. The swatches were allowed to set for an appropriate amount of time (aged about one week). Three sets of swatches were run in triplicate and were contacted with 1) paraffin oil only, as a solvent treatment; 2) dense $CO_2$ only; and 3) a combination of dense $CO_2$ and paraffin oil.

In the treatment with paraffin oil only, Baker parafin oil with a viscosity of about 350 cps at about 37.7° C., was applied to the dirty swatch, was allowed to soak in and dried for 15 minutes. The amount of oil used was about 1 gram per swatch (also 1g).

In the latter two treatments, the swatches were placed in the reaction chamber (autoclave) and $CO_2$ (about 800 psi, 20° C.) was applied as described above. In treatment 2), the swatch were contacted with $CO_2$ as described. In treatment 3), the inventive treatment, the swatch was first contacted with 1g of paraffin oil and allowed to set for 15 minutes. The mass of $CO_2$ used was about 1750 g $CO_2$ (the volume will depend on temperature and pressure used) and time of treatment varied. The relative solubility of the adjunct is significant in determining the amount of $CO_2$ to use versus amount of adjunct. In the case of paraffin oil, it was determined that about 1,800: 1 weight ratio was optimal.

The results are shown below:

TABLE I

| Cleaning Agent | Adjusted % Stain Removal | Std. Dev. (+/−) |
|---|---|---|
| Dense $CO_2$ | 38.0 | 2.2 |
| Paraffin Oil | 0.0 | 3.9 |
| Dense $CO_2$/ Paraffin Oil | 55.5 | 4.0 |

The foregoing results demonstrate the unexpected superiority of the inventive cleaning composition and method over the use of dense $CO_2$ and a cleaning adjunct used singly. The cleaning improvement was much more than merely additive, thus proving a true showing of synergism between the components of the inventive cleaner.

However, It is to be understood that this invention is not limited to these examples. The invention is further illustrated by reference to the claims which follow below, although obvious embodiments and equivalents are covered thereby.

We claim:

1. A method for the removal of nonpolar stains from a fabric comprising:

contacting at least one nonpolar stain which is already present on a fabric first with a nonpolar cleaning adjunct which contains alkanes with a carbon chain length of $C_{16-24}$ in a stain-solubilizing or -removing amount and thereafter, with a fluid medium which is either densified or supercritical carbon dioxide in an amount effective to remove said at least one stain; and removing said stain.

2. The method of claim 1 wherein densified carbon dioxide is used as the fluid medium.

3. The method of claim 1 wherein said densified carbon dioxide is liquid carbon dioxide.

4. The method of claim 1 wherein said fluid medium is supercritical carbon dioxide.

5. The method of claim 1 wherein said densified carbon dioxide has a pressure, at room temperature, of greater than 800 psi.

6. The method of claim 1 wherein said cleaning adjunct has a viscosity of 0.5 cps or greater at standard temperature and pressure.

7. The method of claim 1 wherein said cleaning adjunct is mineral oil.

8. The method of claim 1 1 wherein said cleaning adjunct is petrolatum.

* * * * *